US009192955B2

(12) United States Patent
Braspenning et al.

(10) Patent No.: US 9,192,955 B2
(45) Date of Patent: Nov. 24, 2015

(54) DEVICE FOR CARRYING OUT SURFACE TREATMENT

(75) Inventors: Johan George Heinrich Braspenning, Amsterdam (NL); Stefan Antonie Braspenning, Amsterdam (NL); Allard Maij, Diemen (NL); Hendrik Bastiaan Dorman, Diemen (NL)

(73) Assignee: SPUITKORF B.V., Amsterdam (NL)

( * ) Notice: Subject to any disclaimer, the term of this patent is extended or adjusted under 35 U.S.C. 154(b) by 335 days.

(21) Appl. No.: 13/808,716

(22) PCT Filed: Jul. 4, 2011

(86) PCT No.: PCT/NL2011/050478

§ 371 (c)(1),
(2), (4) Date: Feb. 5, 2013

(87) PCT Pub. No.: WO2012/005574

PCT Pub. Date: Jan. 12, 2012

(65) Prior Publication Data

US 2013/0119155 A1 May 16, 2013

(30) Foreign Application Priority Data

Jul. 7, 2010 (NL) ..... 2005047

(51) Int. Cl.
*B05B 15/12* (2006.01)
*B05B 13/00* (2006.01)
*B05B 15/04* (2006.01)

(52) U.S. Cl.
CPC ..... *B05B 13/005* (2013.01); *B05B 15/0425* (2013.01); *B05B 15/0431* (2013.01)

(58) Field of Classification Search
CPC ..... B05B 15/0425; B05B 15/0431; B05B 13/005
See application file for complete search history.

(56) References Cited

U.S. PATENT DOCUMENTS

| | | | | |
|---|---|---|---|---|
| 4,825,598 | A | 5/1989 | Schlick | |
| 5,367,841 | A * | 11/1994 | Smith et al. | 451/89 |
| 5,502,868 | A | 4/1996 | Braendle | |
| 5,688,323 | A | 11/1997 | Kane et al. | |
| 2010/0009616 | A1 * | 1/2010 | Norcross | 454/53 |

FOREIGN PATENT DOCUMENTS

| | | |
|---|---|---|
| DE | 43 28 410 A1 | 3/1995 |
| EP | 0 631 849 A1 | 1/1995 |

(Continued)

OTHER PUBLICATIONS

International Search Report, dated Nov. 2, 2011, from corresponding PCT application.

*Primary Examiner* — Dah-Wei D Yuan
*Assistant Examiner* — Stephen Kitt
(74) *Attorney, Agent, or Firm* — Young & Thompson

(57) ABSTRACT

Device for carrying out surface treatment on large objects, such as spray-painting of ships. In the prior art, a substantial proportion of the spray mist is deposited elsewhere, which is unwanted. The device proposes an enclosure which is movable along the hull of the ship, from which the spray-painting operation can be carried out through an opening disposed in the enclosure. An air curtain extending to the hull of the ship is present around this opening, through which it is not possible for spray to escape between the enclosure and the ship's hull. An extraction facility for mist is present in the enclosure and supply openings for air are provided. The enclosure consists of a housing which is accessible via a door.

18 Claims, 4 Drawing Sheets

(56) References Cited

FOREIGN PATENT DOCUMENTS

| | | | |
|---|---|---|---|
| FR | 2 603 219 | A1 | 3/1988 |
| JP | 6 269709 | A | 9/1994 |
| WO | 97/48527 | A1 | 12/1997 |
| WO | 2010/057942 | A1 | 5/2010 |

* cited by examiner

DEVICE FOR CARRYING OUT SURFACE TREATMENT

BACKGROUND OF THE INVENTION

1. Field of the Invention

The present invention relates to a device for carrying out a surface treatment on objects such as ships. A surface treatment of this type may involve the spray-painting of the hulls of ships, but may also comprise any other surface treatment on objects, such as the blasting of, for example, bridge parts.

2. Description of the Related Art

In the prior art, the hulls of ships are painted by moving a person along the ship's hull with, for example, a hydraulic platform. The person operates a spray-gun, with which atomised paint is applied to the ship's hull from a relatively short distance.

However, due to wind and other environmental factors, a substantial part of the atomised paint escapes and is deposited on areas where it is not wanted. As a result, on the one hand, the efficiency of the application of the paint is relatively low and, on the other hand, problems arise for the environment.

An enclosure is known from U.S. Pat. No. 5,688,323 which is disposed at a very short distance from the wall to be treated, and wherein a person is located with the upper body inside the enclosure and with the lower body outside it. A vacuum is created in the enclosure with a fan, wherein air is drawn out from the slit between the enclosure and the surface to be processed.

SUMMARY OF THE INVENTION

The object of the present invention is to solve this problem by means of a more appropriate manner of applying paint or other atomised products to relatively large objects such as ships.

This object is achieved with a device for carrying out a surface treatment on large objects, such as ships, comprising an enclosure disposed on the end of an arm manoeuvrable into various positions, said enclosure being provided with a closable access-opening for the accommodation of a person therein, and wherein a supply of medium to be sprayed and an atomiser, such as a spray-gun, are present in said enclosure, said enclosure being provided with walls, a roof and a floor, wherein one of these walls is provided with an opening through which the medium to be sprayed can be applied, wherein said wall in which said opening is located is provided with an air outlet mouthpiece for the realisation of an air curtain present around the atomisation.

According to the present invention, a substantially closed enclosure is provided. This enclosure is provided with an opening, through which the person located in the enclosure can apply a medium such as, for example, paint with, for example, a spray-gun to a large object such as the hull of a ship.

It is possible to seal the opening entirely or partially with a transparent panel such as a panel made from Plexiglas.

The arm may form part of a manned or unmanned, motorised or unmotorised hydraulic platform, which may be embodied in any manner.

According to the invention, an air curtain is disposed around the atomisation. This air curtain is preferably a closed ring and, more particularly, is disposed so that it lies directly around the opening. An air curtain of this type can be implemented according to a special embodiment of the invention by applying an air outlet mouthpiece which, for example, is formed by a pipe which extends along the circumference of the opening and is provided with a large number of air outlet openings. These air outlet openings may have any shape, such as round, rectangular and the like. According to a special embodiment, these openings are embodied as slit-shaped and, according to a further design of the present invention, the airstream emerging from the openings can be directed.

According to a special embodiment of the invention, the enclosure is furthermore provided with an extraction facility. This is, for example, present in the front wall and, more particularly, extends around the opening in the vicinity thereof. Furthermore, air extraction openings can be present in, for example, the rear wall and side wall, floor and/or roof. The person located in the enclosure is provided in the conventional manner with protection, i.e. conventional clothing and a (compressed) air mask.

It must be understood that a spraying robot may be disposed in the enclosure instead of a person.

Furthermore, it is possible to embodiment the enclosure as not completely closed. This is possible through the combination of a closing air curtain and an extraction facility.

According to the present invention, the atomisation applied by the person located in the enclosure is either deposited on the ship's hull or encounters the air curtain. In the latter case, the atomisation can still be deposited on the ship's hull or is returned into the enclosure by means of the extraction facility. Due to the presence of the air curtain, atomisation is prevented in each case from coming outside the circumference of the enclosure, i.e. from emerging outside the slit-shaped area defined between the enclosure and, for example, the ship's hull, and from being able to be deposited on areas where it is not wanted.

According to a further special embodiment of the present invention, a control is present, with which the arm to which the enclosure is attached and therefore the enclosure can be positioned in relation to the object to be treated. Furthermore, a proximity sensor is provided in the enclosure, wherein the distance from the enclosure to, for example, the hull of a ship can be regulated in an automatic manner and therefore the air curtain obtained with the invention can have and maintain an optimum effect. Only the control in a direction parallel to the surface to be treated then still needs to be performed manually. This movement may possibly also be automated. Operation 10 to move the enclosure can be performed by the person located therein.

Instead of the automatic approaching of the enclosure to the wall of the object to be processed, it is also possible to realise the part of the enclosure directed towards the object to be processed to be movable in relation to the enclosure via, for example, a bellows construction. With a pneumatic, hydraulic or other drive, the foremost part of the enclosure in which the air outlet mouthpiece is located can be moved to a limited extent independently in relation to the enclosure, and can precisely follow the wall of the object to be processed, as a result of which the distance therefrom can be further reduced. Furthermore, conflict with specific government regulations governing the operation of the enclosure can be prevented by means of a construction of this type. The distance between the enclosure and the surface to be treated is preferably 10-50 cm, and, more particularly, approximately 20-30 cm. The enclosure may be constructed in any conceivable manner. It preferably comprises a frame provided with panel material. The enclosure is provided with an access door, through which the person located in the enclosure can enter or leave the enclosure.

BRIEF DESCRIPTION OF THE DRAWING FIGURES

Apart from the aforementioned treatment involving the spray-painting of ships, blasting and the performance of other surface treatments must also be specified.

The invention will be explained in detail below on the basis of an exemplary embodiment shown in the drawing. In the drawings.

DETAILED DESCRIPTION OF THE INVENTION

Figure 1:
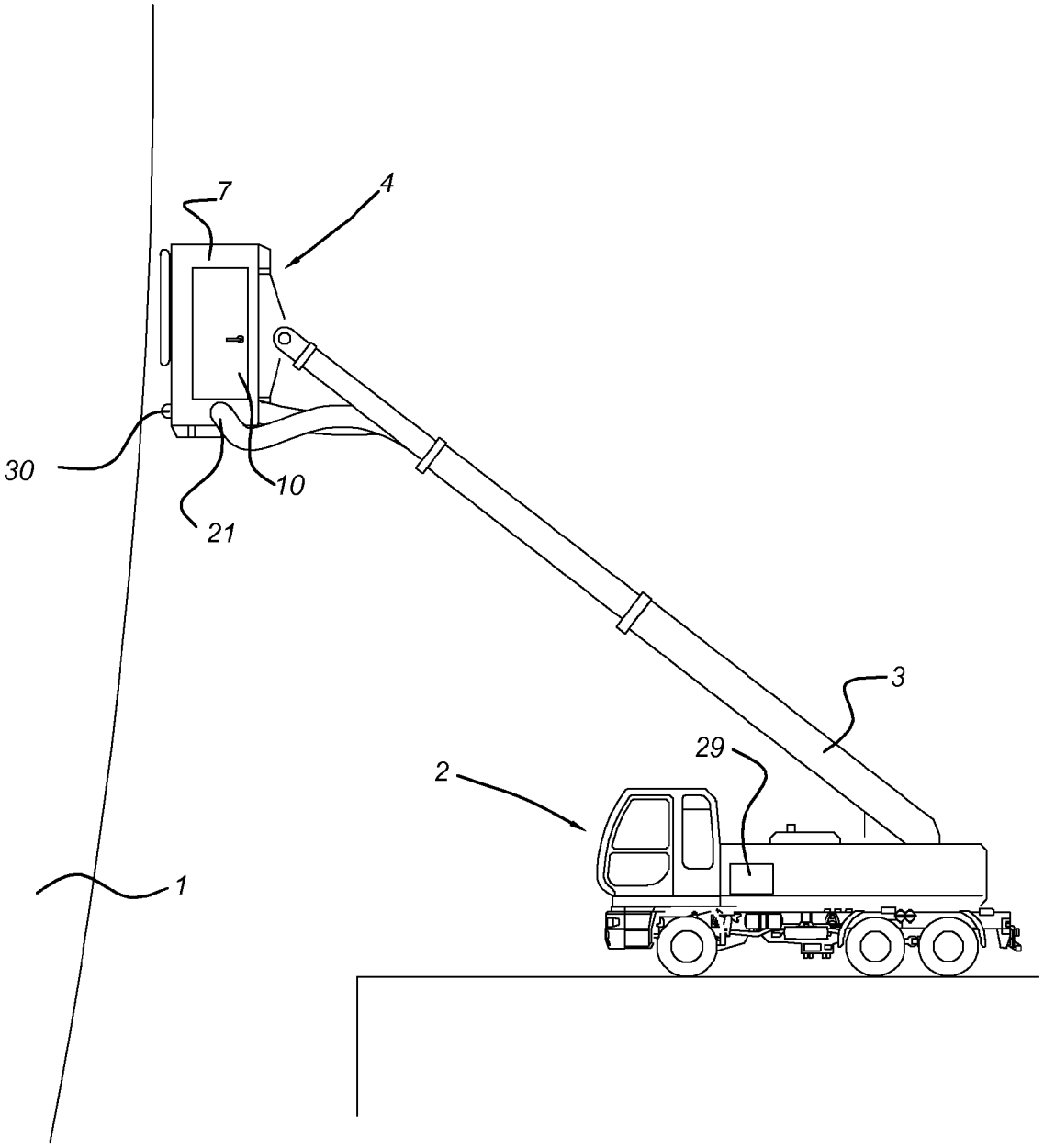
FIG. 1 shows schematically in perspective view the device according to the present invention in combination with a surface to be treated.

In FIG. 1, a surface to be treated such as the hull of a ship is denoted as 1. This needs, for example, to be blasted or provided with a protective layer such as a paint layer.

To do this, a hydraulic platform 2 or other construction is used, which may be embody in any adjustable manner and is provided with a manipulable arm, on the end of which an enclosure 4 is disposed. The enclosure 4 is provided with a roof 5 and a floor 6, and also side walls 7 and 9, which are located opposite one another. Furthermore, the enclosure is provided with a rear wall 8 and a front wall 11. A door 10 (see also FIGS. 2 and 3) is disposed in the side wall 9 to provide access to the enclosure. The front wall 11 is provided with an opening 12. A pipe 13, which is provided with a large number of openings, extends around the opening 12. The pipe 13 is provided with a connection 14 to an air supply. A control, operable by the person present in the enclosure or other person present in the enclosure, for the arm and/or movement of the hydraulic platform may be present in the enclosure. Obviously, movement can also be performed in a different manner, possibly by a different person. The enclosure may be of any conceivable shape, for example aerodynamic to reduce the effects of wind.

Figure 2:
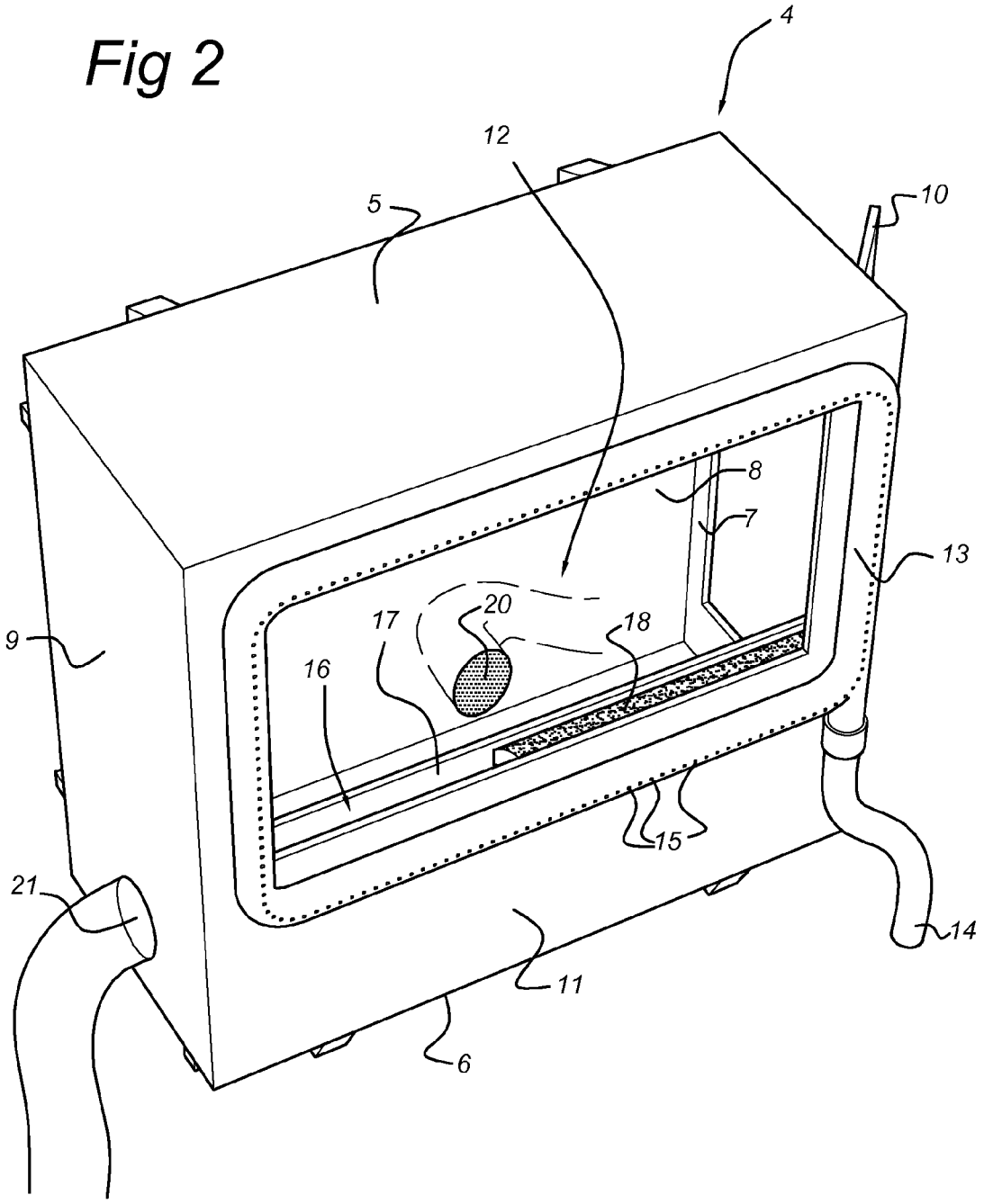
FIG. 2 shows the device according to the present invention from the side of the application opening.

As shown more clearly in FIG. 2, an air outlet 16 is located on the inner edge of the opening 12, i.e. on the side of the inside of the enclosure. This outlet consists of a collecting trough 17, in which a filter 18 is disposed which is connected to an outlet 19, such as a vacuum source.

As shown in the figures, the rear wall is provided with an air extraction opening 20 and the side wall 7 is provided with an air extraction opening 21. A control 29 is present in the hydraulic platform 2. The latter is connected in a manner not shown in detail to a proximity sensor 30 on the enclosure, and it is thus possible to maintain the distance between the front wall 11 of the enclosure 4 in relation to the surface 1 to be treated substantially constant.

Figure 3:
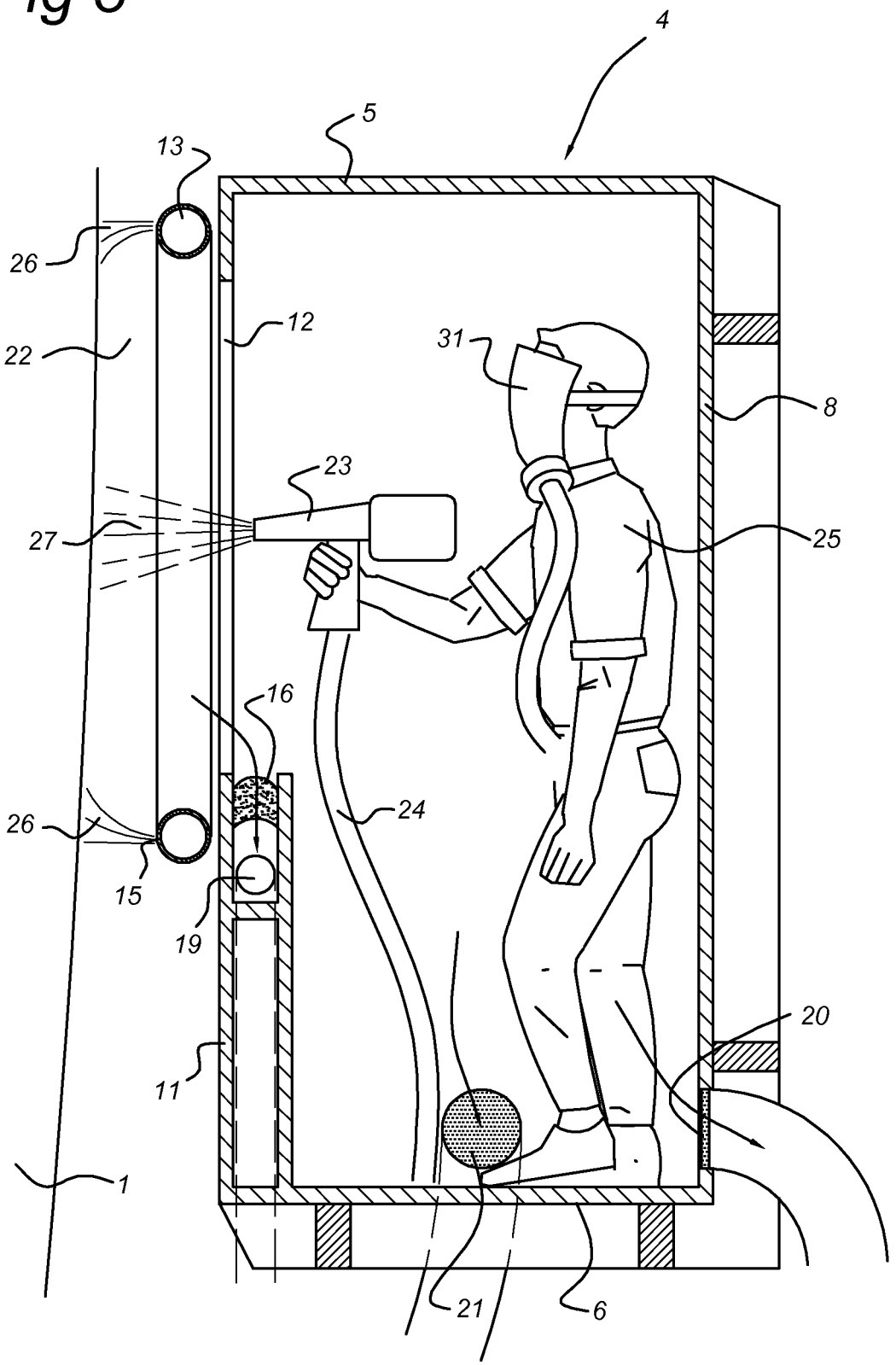
FIG. 3 shows the use of the device according to the present invention.

FIG. 3 shows the operation of the device. A person 25 is present in the enclosure and operates a spray-gun 23 to which an air/paint supply 24 is connected. A second person may be present to control the enclosure. Here, paint, for example, is atomised and is deposited on the surface 1 to be treated. Due to the presence of the pipe 13 and air emerging from the openings 15 thereof, an annular closed air screen 26 results around the opening. It will be understood that this screen may possibly be interrupted. Due to the presence of this screen, spray 27 cannot emerge in an unwanted manner from the slit 22 between the front wall 11 of the enclosure 4 and the surface 1 to be treated.

Spray which is not deposited on the wall 1 and in the enclosure 4 is removed via air outlets 16, 20 and 21. The person 25 is obviously provided with a compressed air mask 31 and protective clothing. A compressed air mask of this type may form part of the enclosure.

According to a special variant of the present invention, the direction in which the air curtain 26 extends can be adjusted. As a result, further optimisation of the protective effect is possible depending on, for example, the weather conditions (wind).

With the exception of the openings shown here, the enclosure according to the present invention is preferably substantially completely sealed. The dose rate of the quantity of air provided in the air curtain 26 can be made weather-dependent. It is thus possible to measure the wind force electronically and define the quantity of air emerging through the openings 15 on the basis thereof.

As an example of dimensions of the enclosure, a width of approximately 1 meter (side wall) is specified, whereas the length and height thereof may both be approximately 2 meters. It will be understood that these dimensions may vary according to the application. The walls and/or floor of the enclosure may be embodied as transparent so that the person located therein can perceive the environment when the enclosure moves.

Figure 4:
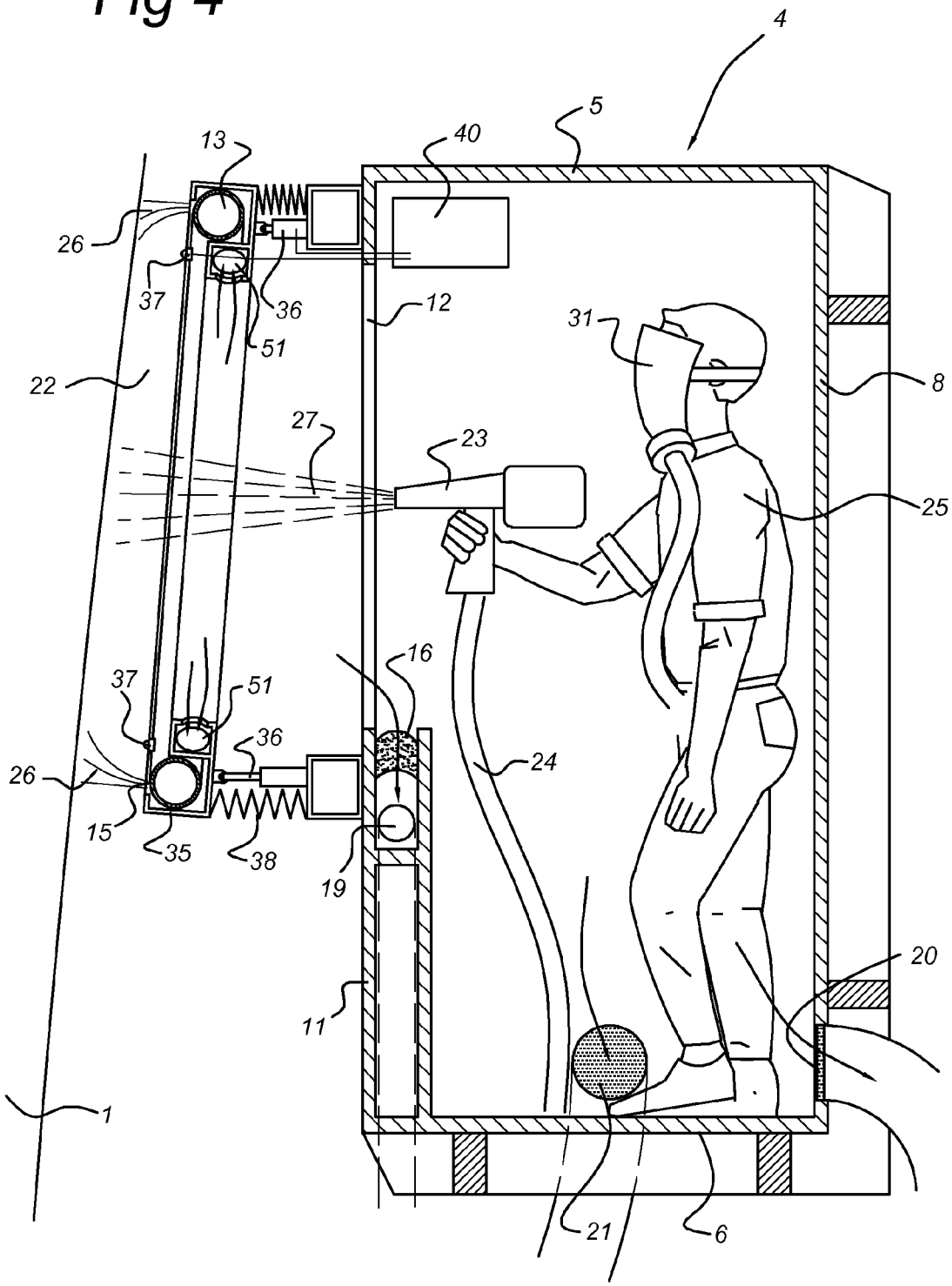
FIG. 4 shows a variant of the aforementioned device.

FIG. 4 shows a variant of the present invention. As far as possible, the same reference numbers as in the earlier example embodiments are used here.

In this variant, the pipe 13 is disposed in a circumferential frame 35. Directly behind the pipe 13, an extraction pipe 51 is disposed in the circumferential frame, extending around it. This pipe may operate instead of or in addition to the outlet 19. This circumferential frame is connected via a number of actuators 36, such as pneumatic jacks, to the remaining part of the enclosure 4. Proximity sensors 37, which are connected to a control 40, are present on the circumferential frame 35. The actuator 36 is also connected to this control 40. A bellows construction is present for an airtight seal between the circumferential frame 35 and the enclosure 4. Actuators 36 may be located both inside and outside a bellows construction of this type. The motors for the extraction facility may be disposed together with possible filters on the enclosure.

The shape of the free end of the circumferential frame may be adapted to the shape of the surface to be treated. In the case of round tanks, this shape may, for example, be embodied as round. The air outlet mouthpiece and possibly the extraction facility can be embodied accordingly.

With a construction of this type, it is possible to hold the enclosure at a slightly greater distance from the ship's hull 1 and, with the actuator 36, provide an accurate adjustment of the position of the pipe 13, which can take place automatically.

With the present invention, it has been possible to limit substantially the quantity of spray or other material which is used in a surface treatment and which ends up elsewhere. Whereas, in the past, up to 30% of the atomisation quantity used was deposited elsewhere, this percentage can now be limited to a few percent.

Apart from the air outlet 16 shown here, further air outlets can be present at other positions in the enclosure in order to further optimise the climate therein.

After reading the above, persons skilled in the art will readily conceive of variants which are obvious following the description and fall within the scope of the accompanying claims.

The invention claimed is:

1. A device for carrying out a surface treatment on objects, or ships, comprising an enclosure disposed on an end of an arm maneuverable into various positions;

a closable access-opening provided in the enclosure, for accommodation of a person therein; and a supply of medium to be sprayed and an atomiser or a spray-gun, are present in said enclosure, said enclosure being provided with walls, a roof and a floor, wherein one of said walls is provided with an opening through which the medium to be sprayed can be delivered, wherein said wall in which said opening is located is provided with an air outlet nozzle for realising of an air curtain present around an atomisation, an outlet direction of air from said air outlet nozzle is directable, said air outlet nozzle being arranged on a circumferential frame that is connected via actuators to said enclosure, allowing the air outlet nozzle to be moved independently in relation to the enclosure.

2. The device according to claim 1, wherein said air outlet nozzle is located near to the circumference of said opening.

3. The device according to claim 1, wherein said air outlet nozzle comprises an elongated slit.

4. The device according to claim 1, wherein an air extraction facility comprising the outlet from the enclosure is provided near said opening.

5. The device according to claim 4, wherein said air extraction facility comprises a filter.

6. The device according to claim 1, wherein one of said walls, not being said wall which is provided with an opening, and a roof or floor, is provided with an air extraction opening.

7. The device according to claim 6, wherein said wall comprises the rear wall.

8. The device according to claim 1, comprising a control for the positioning of the arm in relation to the object and a proximity sensor, embodied in such a way that the distance from the enclosure to the object remains substantially constant.

9. The device according to claim 8, wherein said distance comprises 10-50 cm.

10. The device according to claim 1, wherein said enclosure is designed to accommodate completely said person during said surface treatment.

11. The device according to claim 1, further comprising proximity sensors connected to a control for said actuators.

12. A device for carrying out a surface treatment on a hull of a ship, comprising:

an enclosure disposed on an end of an arm maneuverable into various positions;

a closable access-opening provided in the enclosure, for accommodation of a person therein; and a supply of medium to be sprayed and an atomiser or a spray-gun, are present in said enclosure, said enclosure being provided with walls, a roof and a floor, wherein one of said walls is provided with an opening through which the medium to be sprayed can be delivered, wherein said wall in which said opening is located is provided with an air outlet nozzle for realising of an air curtain present around an atomisation, an outlet direction of air from said air outlet nozzle is directable, said air outlet nozzle being arranged on a circumferential frame that is connected via actuators to said enclosure, allowing the air outlet nozzle to be moved independently in relation to the enclosure.

13. The device according to claim 12, wherein said air outlet nozzle is located near to the circumference of said opening.

14. The device according to claim 12, wherein said air outlet nozzle comprises an elongated slit.

15. The device according to claim 12, wherein an air extraction facility comprising the outlet from the enclosure is provided near said opening.

16. The device according to claim 15, wherein said air extraction facility comprises a filter.

17. The device according to claim 12, wherein one of said walls, not being said wall which is provided with an opening, and a roof or floor, is provided with an air extraction opening.

18. The device according to claim 17, wherein said wall comprises the rear wall.

* * * * *